US005596850A

United States Patent [19]

Kubo

[11] Patent Number: 5,596,850

[45] Date of Patent: Jan. 28, 1997

[54] FIXED WINDOW HAVING GLAZING DEVICE HELD STABLY IN POSITION AGAINST DISPLACEMENT BY WIND PRESSURE

[75] Inventor: Yuichi Kubo, Toyama-ken, Japan

[73] Assignee: YKK Architectural Products Inc., Tokyo, Japan

[21] Appl. No.: 358,903

[22] Filed: Dec. 19, 1994

[30] Foreign Application Priority Data

Dec. 20, 1993 [JP] Japan ..... 5-067738 U

[51] Int. Cl.[6] ..... E06B 3/964

[52] U.S. Cl. ..... 52/204.62; 52/476

[58] Field of Search ..... 52/204.62, 204.69, 52/204.7, 476, 394

[56] References Cited

U.S. PATENT DOCUMENTS

| | | | |
|---|---|---|---|
| 3,090,085 | 5/1963 | Brown | 52/397 X |
| 3,196,998 | 7/1965 | Owen | 52/499 |
| 3,641,728 | 2/1972 | Hallauer | 52/498 |
| 3,872,638 | 3/1975 | Di Fazio . | |
| 4,164,830 | 8/1979 | Bierlich | 52/476 X |
| 4,525,966 | 7/1985 | Litchfield | 52/397 |
| 5,095,676 | 3/1992 | Muhle | 52/476 |
| 5,117,601 | 6/1992 | Habicht | 52/281 |

FOREIGN PATENT DOCUMENTS

| | | | |
|---|---|---|---|
| 3111785 | 10/1982 | Germany | 52/204.62 |
| 2141165 | 12/1984 | Germany | 52/204.7 |
| 2102483 | 2/1983 | United Kingdom | 52/204.62 |

*Primary Examiner*—Carl D. Friedman
*Assistant Examiner*—Beth A. Aubrey
*Attorney, Agent, or Firm*—Finnegan, Henderson, Farabow, Garrett & Dunner, L.L.P.

[57] ABSTRACT

A fixed window includes a glazing device composed of a plate-like base detachably mounted on the inner surface of a frame component arranged outwardly of the peripheral edge of a panel, and a glazing strip mounted on the base for supporting an interior face portion of the panel adjacent the peripheral edge. When the base and the glazing strip are removed, the frame component can be also used as a frame component of a window of the different type. The glazing strip is held in contact with an interior flange of the frame component, so that a positive wind pressure acting on the panel is borne by the flange. The glazing strip can, therefore, be always held stably in position against displacement.

3 Claims, 2 Drawing Sheets

FIXED WINDOW HAVING GLAZING DEVICE HELD STABLY IN POSITION AGAINST DISPLACEMENT BY WIND PRESSURE

BACKGROUND OF THE INVENTION

1. Field of the Invention

The present invention relates generally to a fixed window, and more particularly to a glazing device for firmly clamping a panel, such as a glass pane or a heat-insulating panel, within a frame.

2. Description of the Prior Art

A glazing bead or strip used for holding a glass pane or the like panel within the frame of a fixed window is attached at the final stage, namely after the panel is inserted within the frame. Accordingly, a frame component of the frame, such as a head, a sill or a jamb, is formed with a hook-shaped retaining means or portion for retaining the glazing strip. Owing to the presence of the hook-shaped retaining portion, the frame component forms a counterpart to the glazing strip and hence is produced as a frame component used exclusively for the fixed window. The conventional frame component used for the fixed window is basically unable to divert its usage or application to a different type of window. In order to make the frame component usable also in a different type of window, the hook-shaped retaining portion should be removed to accept an attachment or the like part to be attached to the frame component.

From the functional viewpoint, the retaining portion is only requested to prevent the glazing strip from displacing toward the room interior side. In despite of such limited functional requirement, the retaining portion is provided throughout the length of the frame component. Formation of such a long retaining portion brings about an increase in material cost and production cost.

A glazing structure disclosed in U.S. Pat. No. 3,872,638 includes a frame component having a frame base portion forming a depth plate of the frame component, a glazing block secured to a flat inner surface of the frame base portion for tightly clamping a panel within a frame, and a cover strip fitted over the glazing block for covering the glazing block and supporting an interior face portion of the panel. The glazing block and the cover strip are detachable from the frame component, so that the frame component can be also used as a frame component of a window of a different type by removing the glazing block and the cover strip. However, since the cover strip is snapped on the glazing block via a releasable interlocking engagement between two opposed hooks formed on the opposite legs of the cover strip, and opposite side edges of the glazing block, a transverse force or pressure applied to the panel is borne by the snap connection between the cover strip and the glazing block. Accordingly, when the panel is subjected to a positive wind pressure, the cover strip may be displaced off the glazing block.

SUMMARY OF THE INVENTION

With the foregoing drawbacks of the prior art in view, an object of the present invention is to provide a fixed window having an improved glazing device which enables a frame component to be also used as a frame component in a different type of window, and which is able hold a glazing strip stably in position against displacement by the wind pressure.

A fixed window according to the present invention includes a glazing device which is composed a frame base portion of a frame component arranged outwardly of and surrounding the peripheral edge of a panel, a plate-like base detachably mounted on an inner surface of the frame base portion, and a glazing strip mounted on the base for supporting an interior face portion of the panel adjacent the peripheral edge thereof. Since the base is detachable, the frame component can be also used as a frame component of a different window. The glazing strip is held in contact with an interior face plate or flange of the frame component, so that the glazing strip is held stably in position against displacement even when the panel is subjected to a positive wind pressure.

The base has a retaining portion open at an exterior side. The glazing strip has a locking portion inserted into the retaining portion from the exterior side and interlocked with the retaining portion. With this interlocking engagement, the glazing strip is mounted on the base with its interior side surface held in contact with the interior flange of the frame component. Thus, the panel can be tightly clamped within the frame.

The inner surface of the frame base portion is flat, so that if the base is detached from the frame component, there will be defined in the frame component a reception groove having a flat bottom surface. The reception groove thus defined is able to receive an attachment and other fittings used for supporting a sash. The frame component is now applicable to a window of the type having a sash mounted within the frame.

The glazing strip is held on the base via an interlocking engagement between the locking portion of the glazing strip and the retaining portion of the base. Since the interior side surface of the glazing strip is held in contact with an exterior surface of the interior flange of the frame component, a positive wind pressure exerted on the panel is borne by the interior flange. The positive wind pressure has no effect upon the joint portion between the glazing strip and the base with the result that the glazing strip is highly stable in position against displacement. Since the base is freed from a roll of sustaining the wind pressure, such a long base which is equivalent to the conventional hook-shaped retaining portion is no longer needed, but it may be sufficient to arrange a necessary number of short bases at desired intervals in the longitudinal direction of the frame component. With this arrangement of the bases, the material cost and the production cost can be reduced.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

A preferred embodiment of the present invention will be described in greater detail with reference to the accompanying drawings.

Figure 1:
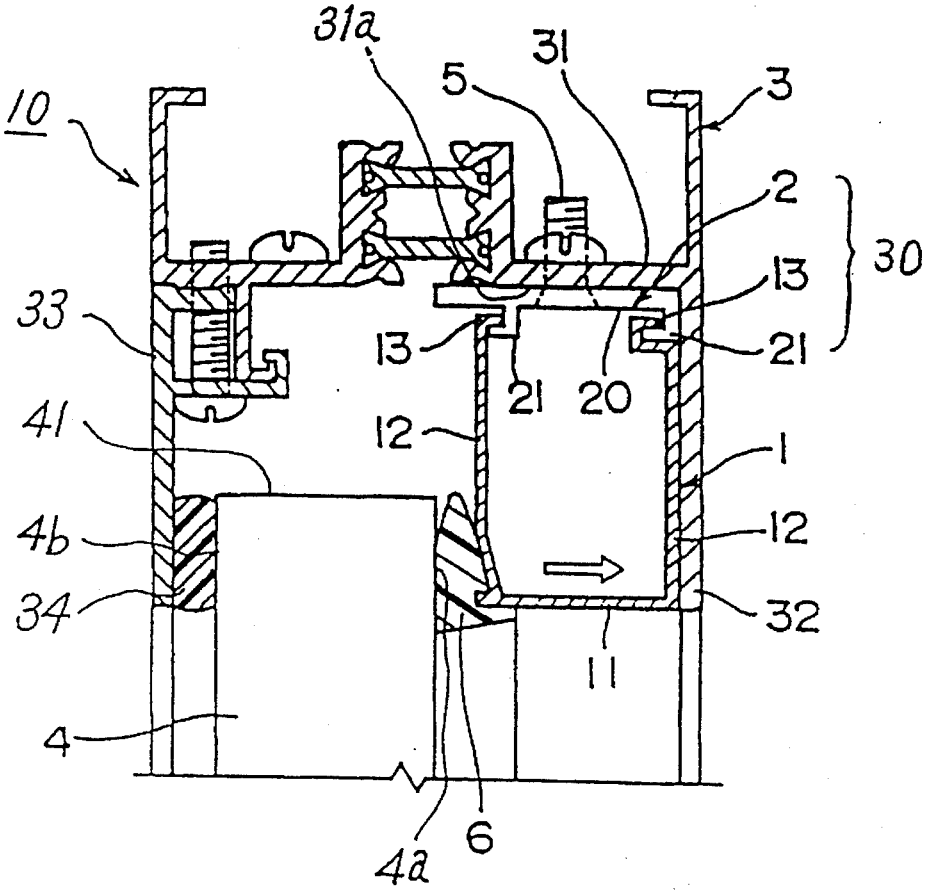
FIG. 1 is a vertical cross-sectional view of an upper portion of a fixed window including a glazing device according to the present invention.

FIG. 1 shows an upper part of a fixed window according to the present invention. The fixed window, also called as glazed window, includes a frame 10, a panel 4, such as a glass pane or an insulating panel, and a glazing means or device 30 for tightly clamping the panel 4 within the frame 10.

The frame 10 includes a frame component 3, such as a head as in the illustrated embodiment, a sill, or a jamb of the frame 10. The frame component 3 has a frame base portion (depth plate) 31 arranged outwardly of and surrounding a peripheral edge portion 41 of the panel 4, and an interior face plate or flange 32 projecting inwardly from an interior edge of the frame base portion 31. The frame base portion 31 and the flange 32 jointly define therebetween a reception groove for receiving therein the peripheral edge portion of the panel 4 or a sash (not shown). The frame base portion 31 has a flat inner surface 31*a*. The flange 32 is confronted with and spaced from an interior face portion 4*a* of the panel 3 adjacent the peripheral edge portion 41 for a purpose described below.

Figure 2:
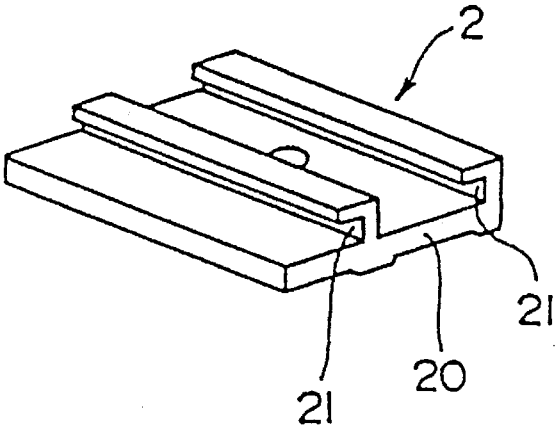
FIG. 2 is a base of the glazing device.

The glazing device 30 is composed of a base 2 detachably mounted on the flat inner surface 31*a* of the frame base portion 31 adjacent the flange 32, and a glazing strip 1 received in a space defined between the flange 32 of the frame component 3 and the interior face portion 4*a* of the panel 4 for engaging the latter to hold the panel 4 in position within the frame 10. The base 2 is secured by a screw 5 to the frame base portion 31 and has a pair of parallel spaced hook-shaped projections 21, 21 opening or bent in a common direction toward the exterior side. The hook-shaped projections 21 form a retaining portion on the base 2. As shown in FIG. 2, the base 2 has a rectangular plate-like body 20 having on its one surface the abovementioned hook-shaped locking projections 21. Two or more of such plate-like base 2 are attached to the frame base portion 31 at intervals along the length of the frame component 3. The number of the base 2 used is determined depending on the length of the frame component 3.

The glazing strip 1 is substantially U-shaped in transverse cross section and includes a pair of spaced legs 12 interconnected at one end by a base portion 11. The legs 12, 12 have a pair of locking projections 13, 13, respectively, projecting from respective free ends of the legs 12 in a common direction toward the interior side. The locking projection 13 jointly form a locking portion on the glazing strip 1. The locking projections 13 are releasably engaged with the hook-shaped retaining projections 21 from the exterior side to attach the glazing strip 1 to the base 2. One of the legs 12 of glazing strip 1 which is located on the interior side is held in face-to-face contact with an exterior surface of the flange 32. The U-shaped cross-section of the glazing strip 1 should be construed as preferable but not restrictive.

Since the glazing strip 1 is attached to the base 2 with its one leg 12 held in contact with the flange 32, a positive wind pressure acting on the panel 4 is transmitted via the glazing strip 1 to the flange 21, as indicated by the arrow shown in FIG. 1. With this arrangement, the base 2 is completely freed from a role of bearing the wind pressure. Accordingly, from the functional viewpoint, the base 2 is only required to hold the glazing strip 1 in position against displacement, such as dropping as in the case of the illustrated embodiment, By virtue of the interlocking engagement between the locking projections 13 and the hook-shaped retaining projections 21, the glazing strip 1 and the base 2 are firmly and stably held together against separation.

In assembly, a necessary number of bases 2 are attached to the frame component 3, and subsequently the panel 4 is placed in the frame 10 such that an exterior face portion 4*b* (FIG. 1) of the panel 4 is held in abutment with an exterior face plate 33 either directly or with the agency of a seam member 34 as in the illustrated embodiment. The exterior face plate 33 has been attached to the frame base portion 31 adjacent to the exterior edge and extending therefrom in parallel confrontation with the interior face plate or flange 32. Then, the glazing strip 1 is attached to the bases 2, and finally a seal member 6, such as a gasket or a weatherstrip, is fitted between the interior face portion 4*a* of the panel 4 and the glazing strip 1. The glazing strip 1 is firmly gripped between the seal member 1 and the flange 32.

Figure 3:
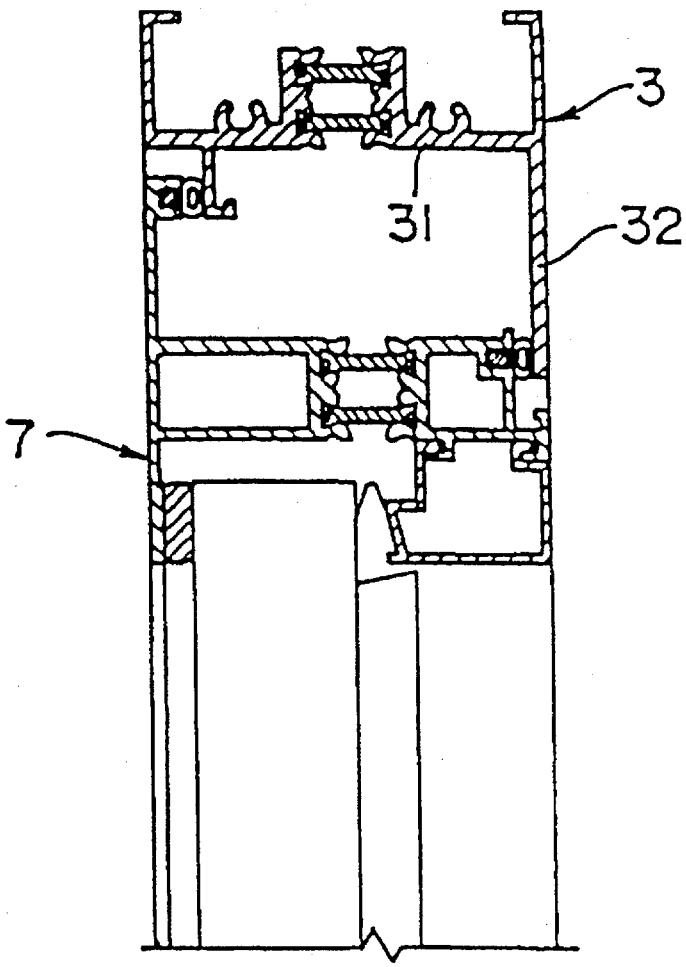
FIG. 3 is a vertical cross-sectional view of an upper portion of a bottom-hinged swinging window in which a frame component used in the fixed window of FIG. 1 is used.

FIG. 3 illustrates an upper part of a bottom-hinged swinging window including a frame component (head) 3 which is formed from the frame component 3 shown in FIG. 1. In this case, the glazing strip 1, the base 2 and the exterior face plate 33 are detached from the frame component 3, and the panel 4 is replaced with a sash 7. As is apparent from FIG. 3, after the glazing strip 1 and the base 2 are removed, the inner surface of the frame base portion 31 is flat and free from projection, and the frame component 3 can now be used in a window of a different type.

As described above, a glazing strip is held in position by a base which is detachably mounted on a flat inner surface of a frame portion. Once the glazing strip and the base are detached, there is defined in the frame portion a reception groove in which an attachment and other fittings used, for example, for supporting a sash are received. The frame portion can now be used in common between different types of windows.

The glazing strip is held in contact with an interior flange of the frame component so that a positive wind pressure acting on a panel is borne by the flange. The wind pressure has a negligible effect upon a joint or connection between the glazing strip and the base. Accordingly, the glazing strip can be held stably in position against displacement even when the panel is subjected to a severe positive wind pressure.

Furthermore, since the base is freed from a role of sustaining the wind pressure, such a long base which extends throughout the length of the frame component is no longer needed. In practice, it is sufficient to arrange two or more rectangular plate-like bases at appropriate intervals in the longitudinal direction of the frame component. With this arrangement, the material cost and the production cost can be reduced.

Obviously, various minor changes and modifications of the present invention are possible in the light of the above teaching. It is therefore to be understood that within the scope of the appended claims the invention may be practiced otherwise than as specifically described.

What is claimed is:

1. A fixed window comprising:

(a) a panel with an inner face and an outer face;

(b) a window frame including a frame component with an inner edge and an outer edge, said frame component comprising:

(i) a frame base portion positioned outwardly of a peripheral edge of said panel, and (ii) a flange positioned on the inner edge of the frame component, said flange projecting toward the panel and beyond the peripheral edge of said panel; and (c) a glazing device for clamping said panel within said window frame, said glazing device comprising:

(i) a plate-like base detachably mounted to a surface of a panel side of the frame base portion, said plate-like base including a retaining portion open toward the outer edge of the frame component; and (ii) a glazing strip engageable with the base and positioned between the flange of the frame component and the inner face of said panel;

wherein the glazing strip is held in contact with the flange and is attached to the base by a locking portion of the glazing strip which releasably engages with the retaining portion.

2. A fixed window according to claim 1, wherein said retaining portion of said base is composed of a pair of spaced hook-shaped projections bent in a common direction toward the outer edge of said frame component, said glazing strip is substantially U-shaped in transverse cross section and has a pair of spaced legs and a pair of locking projections projecting from respective free ends of said legs in a common direction toward the inner edge of said frame component, said locking projections being releasably engaged with said hook-shaped projections of said base.

3. A fixed window according to claim 2, wherein one of said pair of legs is held in face-to-face contact with said flange.

* * * * *